US010674249B2

(12) United States Patent
Wu et al.

(10) Patent No.: US 10,674,249 B2
(45) Date of Patent: Jun. 2, 2020

(54) EXTERNAL SPEAKER ASSEMBLY AND AUDIO APPARATUS

(71) Applicant: JRD COMMUNICATION (SHENZHEN) LTD, Shenzhen, Guangdong (CN)

(72) Inventors: Zhihua Wu, Guangdong (CN); Xiulu Jin, Guangdong (CN); Linfang Li, Guangdong (CN); Wenfei Wu, Guangdong (CN); Siqin Feng, Guangdong (CN)

(73) Assignee: JRD COMMUNICATION (SHENZHEN) LTD, Shenzhen (CN)

( * ) Notice: Subject to any disclaimer, the term of this patent is extended or adjusted under 35 U.S.C. 154(b) by 347 days.

(21) Appl. No.: 15/745,992

(22) PCT Filed: Apr. 7, 2017

(86) PCT No.: PCT/CN2017/079685
§ 371 (c)(1),
(2) Date: Jan. 18, 2018

(87) PCT Pub. No.: WO2018/054036
PCT Pub. Date: Mar. 29, 2018

(65) Prior Publication Data

US 2020/0092635 A1 Mar. 19, 2020

(30) Foreign Application Priority Data

Sep. 22, 2016 (CN) ..... 2016 1 0841651

(51) Int. Cl.
*H04R 25/00* (2006.01)
*H04R 1/28* (2006.01)

(52) U.S. Cl.
CPC ..... *H04R 1/2803* (2013.01); *H04R 2499/11* (2013.01)

(58) Field of Classification Search
CPC ..... H04R 1/2803; H04R 2499/11
USPC ..... 381/337
See application file for complete search history.

(56) References Cited

U.S. PATENT DOCUMENTS 5,852,545 A * 12/1998 Pan-Ratzlaff ..... G06F 1/1601 361/679.23
6,307,947 B1 10/2001 Wiener
7,095,867 B2 * 8/2006 Schul ..... H04R 5/02 381/334

(Continued)

FOREIGN PATENT DOCUMENTS

CN 1988730 A 6/2007
CN 101783981 A 7/2010

(Continued)

*Primary Examiner* — Phylesha Dabney

(57) ABSTRACT

An external speaker assembly and an audio apparatus are disclosed. The external speaker assembly comprises a housing, a speaker unit and a driving circuit; the external speaker assembly is detachably connected to an audio device; when the external speaker assembly is connected to the audio device, a sealed cavity is formed by the housing and a rear cover of the audio device; the speaker unit and the driving circuit are received in the sealed cavity; the driving circuit is configured to connect to the audio device, and receive an audio signal from the audio device to drive the speaker unit to produce sounds.

20 Claims, 2 Drawing Sheets

(56) References Cited

U.S. PATENT DOCUMENTS

| | | | | |
|---|---|---|---|---|
| 2003/0087676 | A1* | 5/2003 | Lloyd ..... | H04B 1/3883<br>455/569.1 |
| 2013/0101150 | A1 | 4/2013 | Yun et al. | |
| 2013/0260823 | A1 | 10/2013 | Shukla et al. | |
| 2015/0341712 | A1 | 11/2015 | Wilcox et al. | |
| 2016/0014525 | A1 | 1/2016 | Park et al. | |

FOREIGN PATENT DOCUMENTS

| | | | |
|---|---|---|---|
| CN | 201839417 | U | 5/2011 |
| CN | 102769729 | A | 11/2012 |
| CN | 202834596 | U | 3/2013 |
| CN | 202841239 | U | 3/2013 |
| CN | 105872862 | A | 8/2016 |
| JP | 2005151236 | A | 6/2005 |
| WO | 2010137988 | A1 | 12/2010 |

* cited by examiner

EXTERNAL SPEAKER ASSEMBLY AND AUDIO APPARATUS

CROSS-REFERENCE TO RELATED APPLICATIONS

The present application is a 35 U.S.C. § 371 National Phase conversion of International (PCT) Patent Application No. PCT/CN2017/079685 filed Apr. 7, 2017, which claims foreign priority of Chinese Patent Application No. 201610841651.2, filed on Sep. 22, 2016 in the State Intellectual Property Office of China, the contents of all of which are hereby incorporated by reference.

TECHNICAL FIELD

Embodiments of the present disclosure generally relate to electroacoustic technology, and in particular relate to an external speaker assembly and an audio apparatus comprising the external speaker assembly.

BACKGROUND

Existing smart apparatuss become lighter and thinner; sizes of screens of the smart apparatuss become larger, while volumes and thicknesses of the smart apparatuss become smaller. It is problematic to produce good speakers due to the increasingly thinner profiles and housings of the smart apparatuss. Generally, a certain space acting as an acoustic chamber (sound producing chamber) is needed for a built-in loudspeaker. When needing to achieve heavy bass effects, more space is needed for the acoustic chamber. Therefore, with the development of the smart apparatuss in a trend of lighter and thinner, the loudspeaking sounds have poor bass effects, and the acoustic quality is also poor.

SUMMARY

In view of the above, the present disclosure provides an external speaker assembly and an audio apparatus capable of improving the bass effect of the loudspeaking sounds and the acoustic quality.

In one aspect, an external speaker assembly is provided. The external speaker assembly comprises a housing, a speaker unit and a driving circuit; wherein the housing comprises a main body in shape of a horn, and a cover plate covering a larger opening of the main body; the driving circuit is carried on the cover plate; the driving circuit comprises a first terminal, a second terminal, a third terminal and a fourth terminal; the external speaker assembly is detachably connected to an audio device; when the external speaker assembly is connected to the audio device, a sealed cavity is formed by the housing and a rear cover of the audio device; the speaker unit and the driving circuit are received in the sealed cavity; the third terminal is connected to a third interface of the audio device to receive power from the audio device; the second terminal is connected to a second interface of the audio device to send a feedback signal to the audio device, in such a way that the audio device determines whether it is externally connected to the external speaker assembly at present based on the feedback signal; the fourth terminal is connected to a fourth interface of the audio device to receive a control signal from the audio device, and the control signal is configured to control the external speaker assembly to turn on or off; the first terminal is connected to a first interface of the audio device to receive an audio signal from the audio device to drive the speaker unit to produce sounds.

In another aspect, another external speaker assembly is also provided. The external speaker assembly comprises a housing, a speaker unit and a driving circuit; the external speaker assembly being detachably connected to an audio device; when the external speaker assembly being connected to the audio device, a sealed cavity being formed by the housing and a rear cover of the audio device; the speaker unit and the driving circuit being received in the sealed cavity; the driving circuit being configured to connect to the audio device, and receive an audio signal from the audio device to drive the speaker unit to produce sounds.

In a further aspect, an audio apparatus is provided. The audio apparatus comprises an audio device and the external speaker assembly aforesaid detachably connected to the audio device.

Advantages of the disclosure may follow. The external speaker assembly of the present disclosure is externally connected to the audio device. An acoustic chamber having a larger space may be provided by utilizing the sealed cavity having a larger space in the external speaker assembly, and thus the bass effect of the loudspeaking sounds and the acoustic quality may be improved.

DETAILED DESCRIPTION

Technical solutions of various illustrative embodiments provided in the present disclosure will be clearly and completely described with reference to the accompanying drawings of the embodiments. The embodiments and technical features in the embodiments described below may be combined with each other in the absent of confliction. Besides, terms indicating directions used in the present disclosure, such as "up", "down" or the like, are intended to illustrate the various embodiments better, and not intended to limit the protection scope of the present disclosure.

Figure 1:
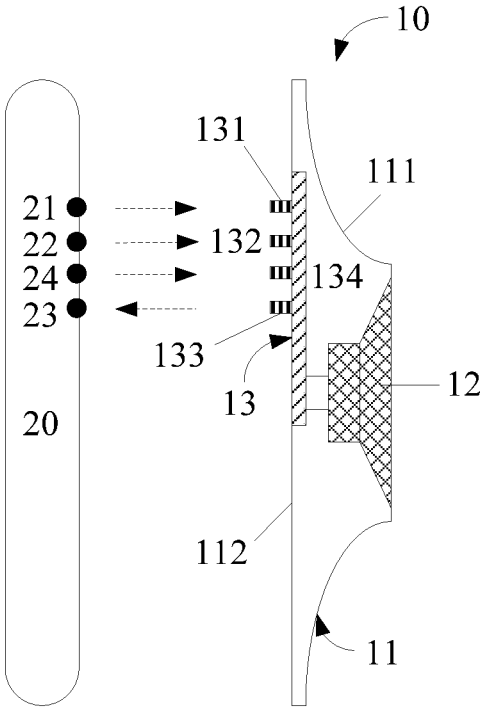
FIG. 1 is a structural side view of one embodiment of an external speaker assembly and an audio device of the present disclosure, in which the external speaker assembly and the audio device are separated from each other.
Figure 2:
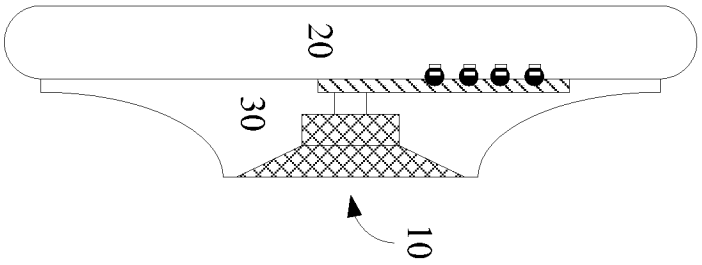
FIG. 2 is a structural side view illustrating that the external speaker assembly and the audio device shown in FIG. 1 are connected to each other.

Referring to FIG. 1 and FIG. 2, an external speaker assembly of one embodiment of the present disclosure is provided. The external speaker assembly 10 may comprise a housing 11, a speaker unit 12 and a driving circuit 13. The external speaker assembly 10 may be detachably connected to an audio device 20. When the external assembly 10 is connected to the audio device 20, a sealed cavity 30 may be formed by the housing 11 of the external speaker assembly 10 and a rear cover of the audio device 20. The speaker unit 12 and the driving circuit 13 may be received in the sealed cavity 30. Meanwhile, the driving circuit 13 may partially extend out of the sealed cavity 30, and be configured to connect to the audio device 20, and further receive audio signals from the audio device 20 to drive the speaker unit 12 to produce sounds.

In practical applications, the driving circuit 13 may be arranged on a printed circuit board (Sub PCB; herein the printed circuit board may be also called as sub print circuit board for distinguishing from a main print circuit board of the audio device 20). The housing 11 may include a main body 111 in shape of a horn. A larger opening of the main body 111 may be oriented towards the rear cover of the audio device 20, while a larger opening of the speaker unit 12 may be away from the acoustic cover 20. Furthermore, a cover plate 112 may be further provided on the larger opening of the housing 11. The cover plate 112 may be configured to cover the larger opening of the housing and further carry the driving circuit 13.

Compared with the prior art, in the embodiments of the present disclosure, it is equivalent to externally connecting a speaker to the audio device 20. Therefore, the sounds to be loud spoken will be limited by the sealed cavity 30 of the external speaker assembly 10, rather than limited by inner space of the audio device 20. Based on this, it is possible to provide an acoustic chamber having a larger space only by increasing the space of the sealed cavity 30, thereby improving the bass effect of the loudspeaking sounds and the acoustic quality.

For example, an existing mobile phone generally has a thickness of 6-9 mm. In this way, less space may be left for the acoustic chamber due to the thinner thickness, and thus the acoustic quality of the loudspeaking sounds is poor. The loudspeaking sounds in this case may generally have a low-frequency resonance frequency of approximately 900 Hz, and low-frequency sounds may be greatly absent.

In this way, the loudspeaking sounds from the mobile phone may be screechy and weak, and lack of liveness. However, when using the external speaker assembly 10 of the present disclosure, the space of the acoustic chamber may be increased; for example, the larger opening of the main body 111 of the housing 11 may be designed to completely cover the rear cover of the mobile phone, and thus the low-frequency resonance frequency of the loudspeaking sound may be decreased from 900 Hz to 400 Hz. In this way, the loudspeking sounds from the mobile phone may become thick and strong, and the sounds may become richer.

In the embodiments of the present disclosure, the external speaker assembly 10 being connected to the audio device 20 is the premise for ensuring that the speaker unit 12 may acquire the audio signals from the audio device 20 and produce sounds. The signal transmission between the external speaker assembly 10 and the audio device 20 may be described below.

Referring also to FIG. 1 and FIG. 2, the driving circuit 13 of the external speaker assembly 10 may include a first terminal 131, a second terminal 132, a third terminal 133 and a fourth terminal 134. Correspondingly, the audio device 20 may be prearranged with a first interface 21, a second interface 22, a third interface 23 and a fourth interface 24 thereon. In this case, the first interface 21 may be implemented as an audio signal output (Audio Signal) interface; the second interface 22 may be implemented as a peripheral equipment detection (ID_Detect) interface; the third interface 23 may be implemented as a power supply (Power) interface; and the fourth interface 24 may be implemented as a control signal (Control) interface.

When the external speaker assembly 10 is connected to the audio device 20, the third terminal 133 may be connected to the third interface 23, in such a way that the external speaker assembly 10 may receive power from the audio device 20.

The second terminal 132 may be connected to the second interface 22, and the audio device 20 may determine whether an external speaker assembly 10 is externally connected to the audio device at present based on a level of the second interface 22. In specific, the external speaker assembly 10 may send a feedback signal to the audio device 20 via the second terminal 132, such that the audio device 20 may determine whether the external speaker assembly 10 is externally connected to the audio device at present based on the feedback signal. The feedback signal actually belongs to a kind of electrical signal, and may include a high level signal and a low level signal. When the audio device 20 detects that the feedback signal received by the second interface 22 is the high level signal, it may indicate that the external speaker assembly 10 is externally connected to the audio device 20. However, when the audio device 20 detects that the feedback signal received by the second interface 22 is the low level signal, it may indicate that no external speaker assembly 10 is externally connected to the audio device 20.

The fourth terminal 134 may be connected to the fourth interface 24, and the audio device 20 may send a control signal to the external speaker assembly 10 via the fourth interface 24 to control the external speaker assembly 10 to turn on or off. The control signal also actually belongs to one kind of the electrical signal, and may include a high level signal and a low level signal. When the control signal transmitted from the audio device 20 to the external speaker assembly 10 is the high level signal, it may indicate that the external speaker assembly 10 is turned on. When the control signal transmitted from the audio device 20 to the external speaker assembly 10 are the low level signal, it may indicate that the external speaker assembly 10 is turned off.

The first terminal 131 may be connected to the first interface 21, and the audio device 20 may send the audio signals of the sounds that need to be played to the external speaker assembly 10 via the first interface 21, in such a way that sounds may be loud spoken via the speaker unit 12 of the external speaker assembly 10. In this case, when the audio device 20 is an audio device capable of sending out sound from back, the sounds sent out by the speaker unit 12 may be transmitted in a direction away from the rear cover of the audio device 20.

It could be understood that, the external speaker assembly 10 may be connected to the audio device 20 by many other ways, and may not be limited to the four interfaces and four terminals described above.

In the embodiments described above, the audio device 20 may be implemented as a portable audio device such as a smartphone, a PDA (Personal Digital Assistant), a tablet computer, or the like. Optionally, the audio device 20 may also be implemented as a wearable device that may be worn on limbs or embedded in clothes, ornaments, accessories. Optionally, the audio device 20 may also be implemented as other intelligent electronic device having the function of transmitting the audio signals.

An audio apparatus may also be provided in one embodiment of the present disclosure. The audio apparatus may comprise an audio device and an external speaker assembly detachably connected to the audio device. Wherein the audio device corresponds to the audio apparatus 20 aforesaid. Of course, it is possible for the audio device to have no function of sounds loud speaking; however, the audio device may produce the audio signals and loud speak the sounds via the external speaker assembly. The external speaker assembly may be implemented as the external speaker assembly 10 in the embodiments described above, and thus it has the same beneficial effects as the external speaker assembly 10.

Again, the above description depicts merely some exemplary embodiments of the disclosure, but does not mean to limit the scope of the disclosure. Any equivalent structure or flow transformations made to the disclosure by utilizing the specification and the accompanying drawings of the present disclosure, such as the combination of the technical features of various embodiments, or any direct or indirect applications of the disclosure on other related fields, shall all be covered within the protection of the disclosure.

What is claimed is:

1. An external speaker assembly, comprising a housing, a speaker unit and a driving circuit; wherein the housing comprises a main body in shape of a horn, and a cover plate covering a larger opening of the main body; the driving circuit is carried on the cover plate; the driving circuit comprises a first terminal, a second terminal, a third terminal and a fourth terminal; the external speaker assembly is detachably connected to an audio device; when the external speaker assembly is connected to the audio device, a sealed cavity is formed by the housing and a rear cover of the audio device; the speaker unit and the driving circuit are received in the sealed cavity; the third terminal is connected to a third interface of the audio device to receive power from the audio device; the second terminal is connected to a second interface of the audio device to send a feedback signal to the audio device, in such a way that the audio device determines whether it is externally connected to the external speaker assembly at present based on the feedback signal; the fourth terminal is connected to a fourth interface of the audio device to receive a control signal from the audio device, and the control signal is configured to control the external speaker assembly to turn on or off; the first terminal is connected to a first interface of the audio device to receive an audio signal from the audio device to drive the speaker unit to produce sounds.

2. The external speaker assembly as described in claim 1, wherein the feedback signal comprises a high level signal and a low level signal; the high level signal is configured to indicate that the external speaker assembly is externally connected to the audio device; the low level signal is configured to indicate that the external speaker assembly is not externally connected to the audio device.

3. The external speaker assembly as described in claim 1, wherein the control signal comprises a high level signal and a low level signal; the high level signal is configured to indicate that the external speaker assembly is turned on; the low level signal is configured to indicate that the external speaker assembly is turned off.

4. An external speaker assembly, comprising a housing, a speaker unit and a driving circuit; the external speaker assembly being detachably connected to an audio device; when the external speaker assembly being connected to the audio device, a sealed cavity being formed by the housing and a rear cover of the audio device; the speaker unit and the driving circuit being received in the sealed cavity; the driving circuit being configured to connect to the audio device, and receive an audio signal from the audio device to drive the speaker unit to produce sounds.

5. The external speaker assembly as described in claim 4, wherein the driving circuit comprises a first terminal connected to a first interface of the audio device; the external speaker assembly receives the audio signal from the audio device via the first terminal.

6. The external speaker assembly as described in claim 5, wherein the driving circuit comprises a second terminal connected to a second interface of the audio device; the external speaker assembly sends a feedback signal to the audio device via the second terminal, in such a way that the audio device determines whether it is externally connected to the external speaker assembly at present based on the feedback signal.

7. The external speaker assembly as described in claim 6, wherein the feedback signal comprises a high level signal and a low level signal; the high level signal is configured to indicate that the external speaker assembly is externally connected to the audio device; the low level signal is configured to indicate that the external speaker assembly is not externally connected to the audio device.

8. The external speaker assembly as described in claim 5, wherein the driving circuit comprises a third terminal connected to a third interface of the audio device; the external speaker assembly receives power from the audio device via the third terminal.

9. The external speaker assembly as described in claim 5, wherein the driving circuit comprises a fourth terminal connected to a fourth interface of the audio device; the external speaker assembly receives a control signal from the audio device via the fourth terminal; the control signal is configured to control the external speaker assembly to turn on or off.

10. The external speaker assembly as described in claim 9, wherein the control signal comprises a high level signal and a low level signal; the high level signal is configured to indicate that the external speaker assembly is turned on; the low level signal is configured to indicate that the external speaker assembly is turned off.

11. The external speaker assembly as described in claim 4, wherein the sounds sent out by the speaker unit are transmitted in a direction away from the rear cover of the audio device.

12. The external speaker assembly as described in claim 4, wherein the housing comprises a main body in shape of a horn, and a cover plate covering a larger opening of the main body.

13. An audio apparatus, comprising an audio device and an external speaker assembly detachably connected to the audio device; wherein the external speaker assembly comprises a housing, a speaker unit and a driving circuit; the external speaker assembly is detachably connected to the audio apparatus; when the external speaker assembly is connected to the audio device, a sealed cavity is formed by the housing and a rear cover of the audio device; the speaker unit and the driving circuit are received in the sealed cavity; the driving circuit is configured to connect to the audio device, and receive an audio signal from the audio device to drive the speaker unit to produce sounds.

14. The audio apparatus as described in claim 13, wherein the driving circuit comprises a first terminal connected to a first interface of the audio device; the external speaker assembly receives the audio signal from the audio device via the first terminal.

15. The audio apparatus as described in claim 14, wherein the driving circuit comprises a second terminal connected to a second interface of the audio device; the external speaker assembly sends a feedback signal to the audio device via the second terminal, in such a way that the audio device determines whether it is externally connected to the external speaker assembly at present based on the feedback signal.

16. The audio apparatus as described in claim 15, wherein the feedback signal comprises a high level signal and a low level signal; the high level signal is configured to indicate that the external speaker assembly is externally connected to the audio device; the low level signal is configured to indicate that the external speaker assembly is not externally connected to the audio device.

17. The audio apparatus as described in claim 14, wherein the driving circuit comprises a third terminal connected to a third interface of the audio device; the external speaker assembly receives power from the audio device via the third terminal.

18. The audio apparatus as described in claim 14, wherein the driving circuit comprises a fourth terminal connected to a fourth interface of the audio device; the external speaker assembly receives a control signal from the audio device via the fourth terminal; the control signal is configured to control the external speaker assembly to turn on or off.

19. The audio apparatus as described in claim 18, wherein the control signal comprises a high level signal and a low level signal; the high level signal is configured to indicate that the external speaker assembly is turned on; the low level signal is configured to indicate that the external speaker assembly is turned off.

20. The audio apparatus as described in claim 13, wherein the housing comprises a main body in shape of a horn, and a cover covering a larger opening of the main body.

* * * * *